US006346004B1

(12) United States Patent
Daoud

(10) Patent No.: US 6,346,004 B1
(45) Date of Patent: Feb. 12, 2002

(54) TOP ACCESS CAP FOR BARREL IDC CONNECTOR AND CONNECTOR INCLUDING THE CAP

(75) Inventor: Bassel Hage Daoud, Parsippany, NJ (US)

(73) Assignee: Avaya Technology Corp, Basking Ridge, NJ (US)

( * ) Notice: Subject to any disclaimer, the term of this patent is extended or adjusted under 35 U.S.C. 154(b) by 0 days.

(21) Appl. No.: 09/328,610

(22) Filed: Jun. 9, 1999

(51) Int. Cl.[7] ..... H01R 4/26

(52) U.S. Cl. ..... 439/395; 439/409

(58) Field of Search ..... 439/395, 398, 439/400, 401, 403, 409, 417

(56) References Cited

U.S. PATENT DOCUMENTS 4,795,363 A * 1/1989 Scherer et al. ..... 439/395
4,795,364 A * 1/1989 Frantum, Jr. et al. ..... 439/409
4,913,659 A * 4/1990 Doyle ..... 439/395

* cited by examiner

*Primary Examiner*—Tho D. Ta
*Assistant Examiner*—Briggitte R. Hammond
(74) *Attorney, Agent, or Firm*—Duane Morris & Heckscher LLP

(57) ABSTRACT

A connector has a base and a cylindrical terminal attached to the base. The terminal has a hole in its side wall and a horizontal slot extending from the hole. A cap is mounted on the base so as to substantially cover the terminal. The cap has a passage through it. The passage extends diagonally through the cap. The passage has a first end at a top end of the cap and a second end at a side wall of the cap. The passage may penetrate the top surface of the cap, or the passage may penetrate the side surface adjacent to the top corner of the cap. The cap is rotatable between a first position in which the second end of the passage is adjacent the hole of the terminal, and a second position in which the second end of the passage is adjacent the horizontal slot. The side wall of the cap has a hole through it for insertion of a test probe. The cap has at least one position in which the test probe hole of the cap is adjacent to a solid wall of the terminal.

17 Claims, 4 Drawing Sheets

TOP ACCESS CAP FOR BARREL IDC CONNECTOR AND CONNECTOR INCLUDING THE CAP

FIELD OF THE INVENTION

The present invention relates to electronics generally, and more specifically to connectors used in telecommunications.

DESCRIPTION OF THE RELATED ART

FIGS. 1A–1D show a conventional barrel type insulation displacement connector (IDC) 10 manufactured by the 3M Corporation of St. Paul, Minn. Connector 10 may be used for a variety of applications, including but not limited to connecting wires to telecommunications equipment. FIG. 1A is an exploded side elevation view of the connector 10. The connector 10 includes two main portions 20 and 50.

FIGS. 1A and 1D show the bottom portion. The bottom portion 50 has a collar 60 integrally formed as part of the base 62. Bottom portion 50 has a cylindrical terminal 52, that is formed of conductive material. Terminal 52 has a wire receiving hole 54 with a slot 56 connected to the hole. The edges 56*a* of the slot 56 are sufficiently sharp to displace insulation from a wire, thereby to form an electrical connection. Terminal 52 has a second hole 55 (shown in phantom in FIG. 1D) on the wall of the terminal about 180 degrees from hole 54. An outer collar 64 receives the bottom end of cap 20. A bridge 66 connects collar 60 and outer collar 64.

The top portion of connector 10 is a cap 20, shown in FIGS. 1A–1C. The cap 20 fits over the terminal 52, and fits within the outer collar 64. The terminal 52 is received in an annular space 32, and the collar 60 fits in the bore 30 of cap 20. The cap 20 has a horizontal wire receiving hole 22 on a side wall of the cap. The hole 22 passes approximately across a diameter of the cap 20. The cap has a cutout 28 that fits over the bridge 66 on the base 62. The cap 20 is rotatable within an angular range determined by the size of the cutout 28.

The cap 20 has a first angular position in which the hole 22 in the cap is aligned with the holes 54 and 55 in the terminal. A wire (not shown) is insertable through holes 22, 54 and 55. The cap 20 is then rotated, so that the wire is forced into the slot 56, displacing away insulation and forming an electrical connection between the wire and the terminal 52.

The top surface of the cap 20 has a second hole 24. A conventional test probe (not shown) may be inserted into hole 24. The test probe contacts a tab 58 which may be formed from a portion of the terminal 52. The top surface of the cap 20 also has a slot 26 for receiving a screw driver, to facilitate rotation of the cap.

A plurality of the above described connectors may be mounted in a single block having several rows and columns. The connector cap is about 1 centimeter (0.4 inch) in diameter. In some applications, these connectors have been closely spaced, with a center-to-center distance between adjacent connectors of about 1.25 centimeters (0.5 inch), leaving a space of about 0.25 centimeters. With this close spacing, it is difficult to insert a wire into an interior connector.

An improved connector is desired.

SUMMARY OF THE INVENTION

The present invention is a cap for a connector having a hole at its top end, and a connector that includes the cap. The connector includes a base and a cylindrical terminal attached to the base. The terminal has a hole in a side wall of the terminal and a horizontal slot extending from the hole.

The cap is mounted on the base so as to substantially cover the terminal. A passage extends through the cap. The passage has a first end at a top end of the cap and a second end at a side wall of the cap. The cap is rotatable between a first position in which the second end of the passage is adjacent the hole of the terminal, and a second position in which the second end of the passage is adjacent the horizontal slot.

DETAILED DESCRIPTION

Figure 2D:
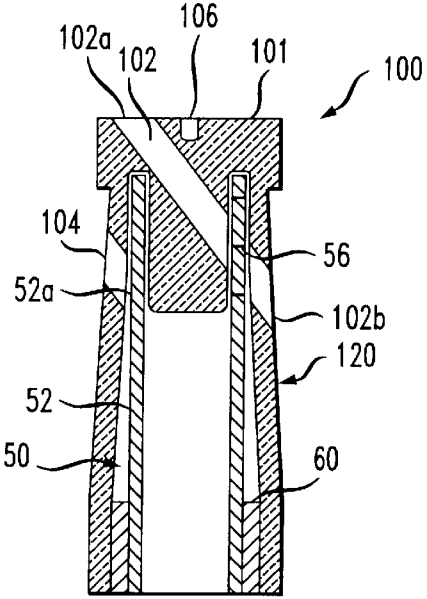
FIG. 2D is a cross-sectional view of the connector of FIG. 2C, taken along section line 2D—2D of FIG. 2C.

In the following description, the term "top" is used to refer to the portion of the device located at the top of FIGS. 2A, 2B and 2D, and shown in FIGS. 2C and 2E. One of ordinary skill in the art understands that this does not limit the orientation in which the device may be used. In particular, a typical exemplary orientation for the device is rotated 90 degrees from the position shown in FIGS. 2A, 2B, 2D. In this exemplary position, the "top" surface shown in FIGS. 2C, 2E and 3 would be positioned in front.

The present invention is an IDC connector that provides easier wire insertion, particularly when the connector is located in a tight clearance space. The present invention allows the wire to be inserted at the top end, in or near the top surface of the connector.

FIGS. 2A–2E show the first exemplary connector 100. In the first exemplary embodiment, the connector 100 may be formed by a combination of the conventional bottom portion 50 (shown in FIG. 1A) with a new replacement cap 120, or by a combination of a modified bottom portion (not shown) with the cap 120.

The connector 100 has a base 62. The base 62 is omitted from FIGS. 2A–2E, for ease of viewing. The cylindrical IDC terminal 52 is attached to the base 62 via collar 60, which may be integrally formed as a part of the base 62. The terminal has a hole 54 in a side wall thereof, and a horizontal slot 56 extending from the hole 54. The slot 56 is surrounded by two edges 56*a* sufficiently sharp to displace insulation from a wire (not shown) for forming an electrical connection.

At least two of the features included in the conventional lower connector portion 50 (FIG. 1A) are not required for the exemplary embodiment. The rear hole 55 (FIG. 1D) is not required, because the wire only passes through one hole 54 of the terminal 52, as explained below. Also, the tab 58 is not required, because a test probe is not inserted through the center of the terminal 52. Thus, the exemplary embodiment may include a different terminal (not shown) than the one shown in FIGS. 1A and 1D. In particular, the exemplary embodiment may include a terminal similar to that shown in FIGS. 1A and 1D, except that the tab 58 and hole 55 are omitted.

The cap 120 is mounted on the base 62. The cap 120 has a side wall 112 and a top surface 101 so as to substantially cover the terminal 52. The cap has a passage 102. The passage 102 has a first end 102*a* at a top end of the cap 120 and a second end 102*b* at a side wall of the cap 120.

Figure 2E:
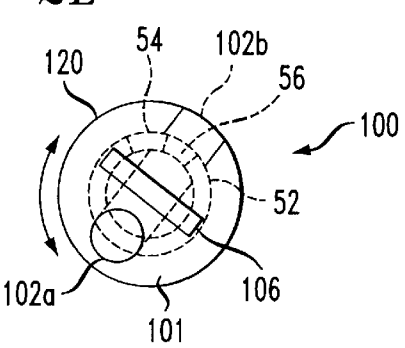
FIG. 2E is a top plan view of the connector of FIG. 2C, with the cap rotated to a second position for forming an IDC connection.
Figure 2B:
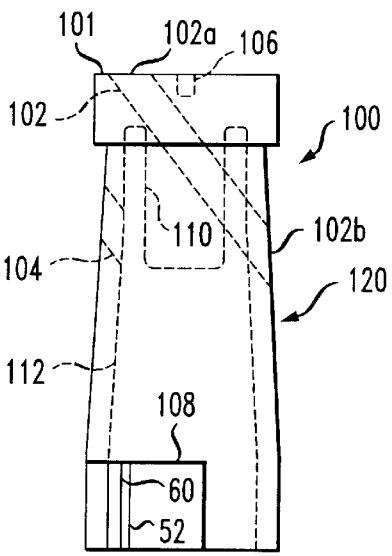
FIG. 2B is a side elevation view of the connector shown in FIG. 2A.
Figure 2C:
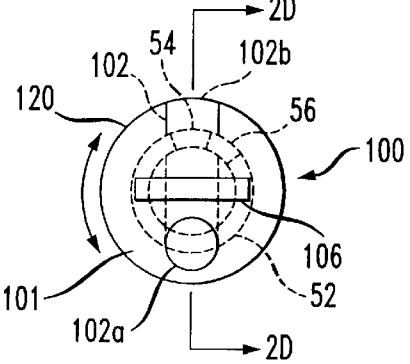
FIG. 2C is a top plan view of the connector shown in FIG. 2A. The cap is shown in a first position, in which a wire is inserted.
Figure 2A:
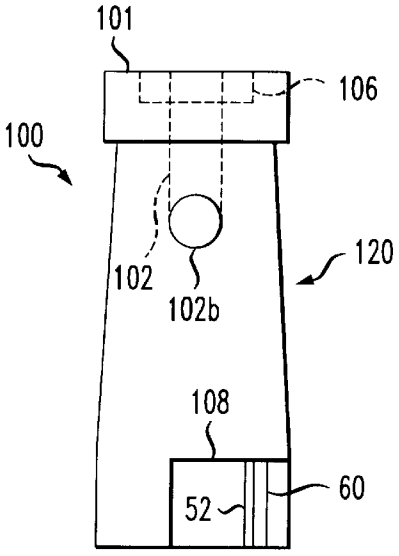
FIG. 2A is a front elevation view of a first exemplary connector according to the invention.

The cap 120 is rotatable between a first position shown in FIG. 2C and a second position shown in FIG. 2E. In the first position (FIG. 2C), the second end 102*b* of the passage 102 is adjacent the hole 54 of the terminal 52. In the second position (FIG. 2E), the second end 102*b* of the passage 102 is adjacent the horizontal slot 56.

The method of forming a connection using the exemplary connector 100 includes: inserting a wire (not shown) through a passage 102 in the cap 120 that begins at a top end of the cap, so the wire exits from hole 102*b* in a side of the cap; and rotating the cap, so that the wire is squeezed between cutting edges 56*a* of the cylindrical terminal 52, to form an electrical connection.

Thus, when the cap 120 is rotated relative to the terminal 52, a wire (not shown) passing through terminal 102 and hole 54 moves along with passage 102, until the wire is forced into the slot 56. The sharp edges 56*a* adjacent to the slot 56 displace sufficient insulation from the wire to form an electrical connection between the wire and the terminal.

The cap 120 has a top surface 101. In the embodiment of FIGS. 2A–2E, the first end 102*a* of the passage 102 penetrates the top surface 101. The passage in the exemplary cap 120 is diagonal. To connect a wire to one of the connectors 100, the wire is inserted diagonally into the passage 102 via hole 102*a*.

Figure 3:
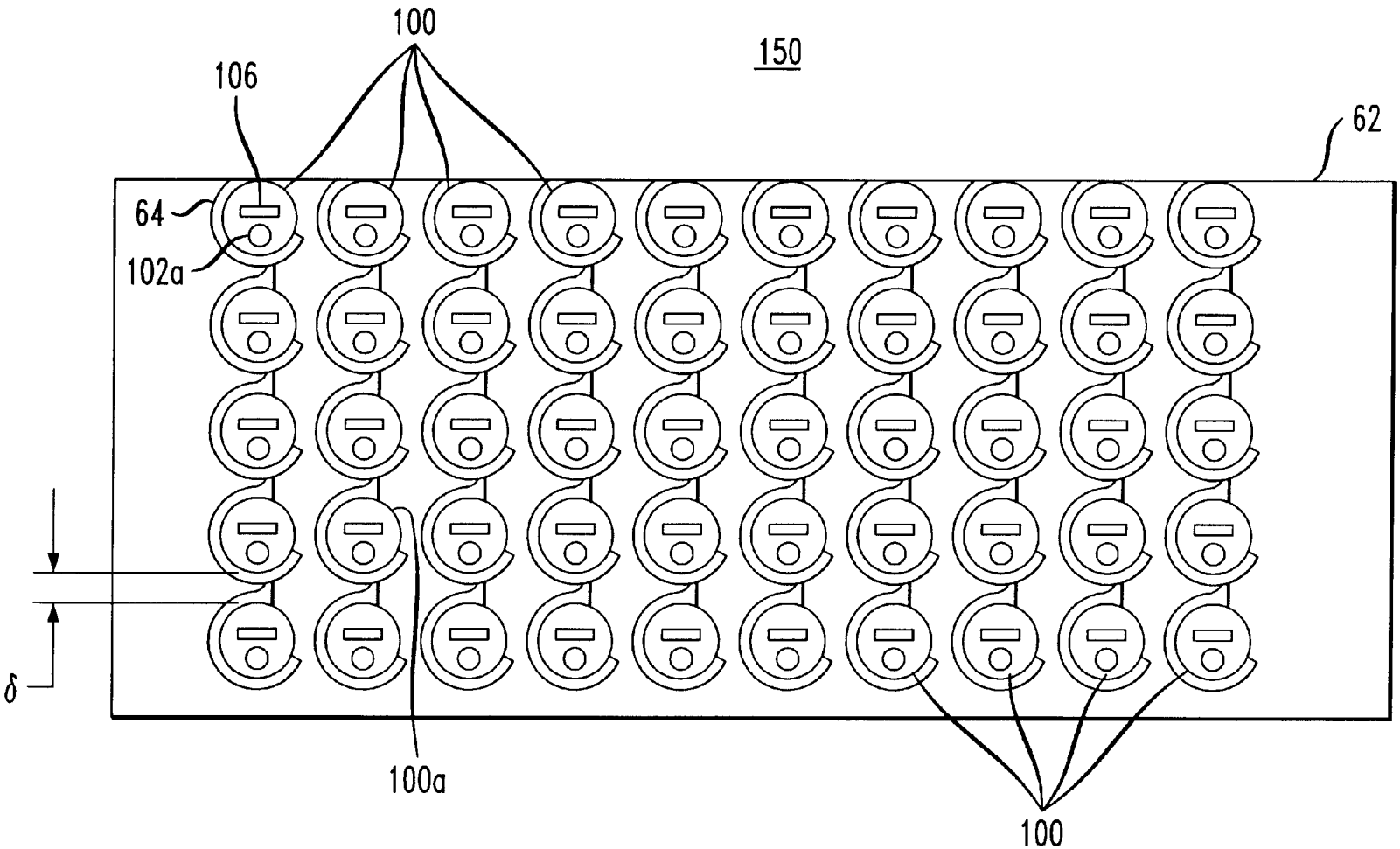
FIG. 3 a top plan view of a block that includes a plurality of the connectors as shown in FIG. 2C.
Figure 4C:
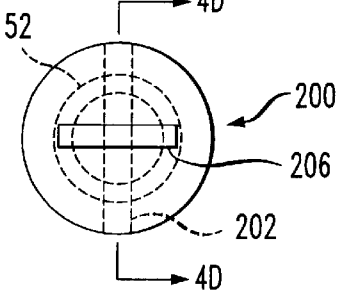
FIG. 4C is a top plan view of the connector shown in FIG. 4A.
Figure 4A:
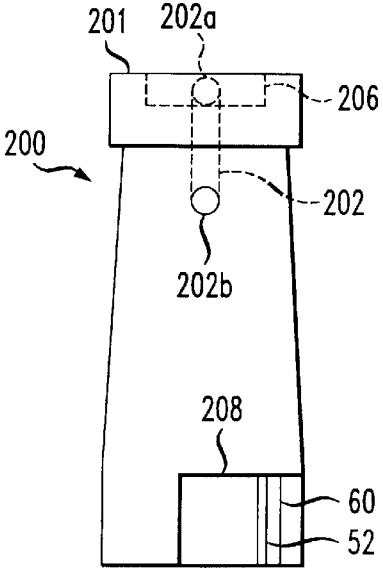
FIG. 4A is a front elevation view of a second exemplary connector according to the invention.
Figure 4B:
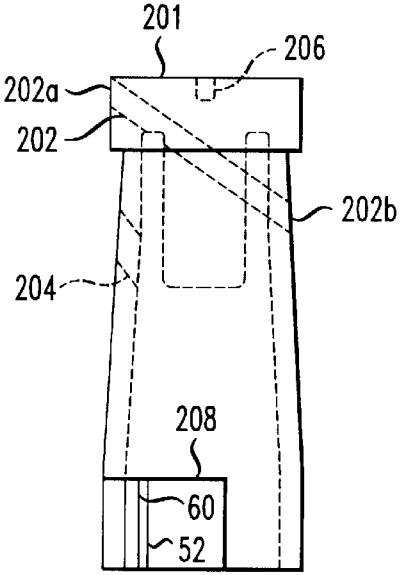
FIG. 4B is a side elevation view of the connector shown in FIG. 4A.
Figure 4D:
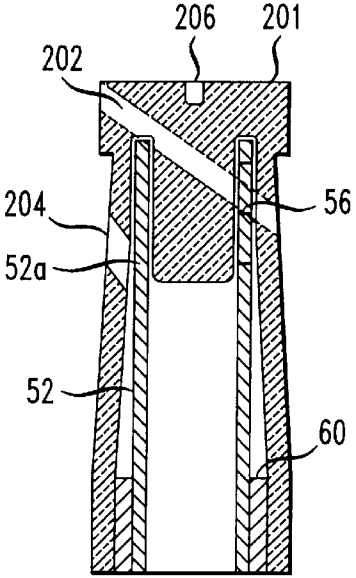
FIG. 4D is a cross-sectional view of the connector of FIG. 4C, taken along section line 4D—4D of FIG. 4C.

FIG. 3 shows an exemplary block 150 containing a plurality of connectors 100. The base 62 has a plurality of connectors arranged in a grid having a plurality of rows and a plurality of columns. An exemplary connector 100*a* is surrounded by additional connectors. In this example, a minimum distance δ between the side wall of the connector 100*a* and a closest side wall of any one of the additional connectors is about three millimeters or less. With connectors spaced this close together (or closer), the provision of a wire receiving hole 102*a* at the top end of the cap 120 makes wire insertion much easier than the side mounted, horizontal wire insertion technique of the prior art shown in FIGS. 1A–1C. Thus the exemplary cap of FIGS. 2A–2E provides simpler access for wire insertion, particularly when inserting a wire into an interior connector (i.e., a connector surrounded by other connectors, or when the side of the cap is difficult to access for any other reason.

Figure 1C:
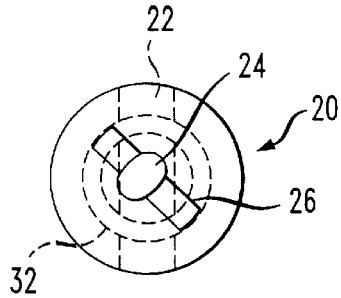
FIG. 1C PRIOR ART
FIG. 1C is a top plan view of the cap shown in FIG. 1B.
Figure 1A:
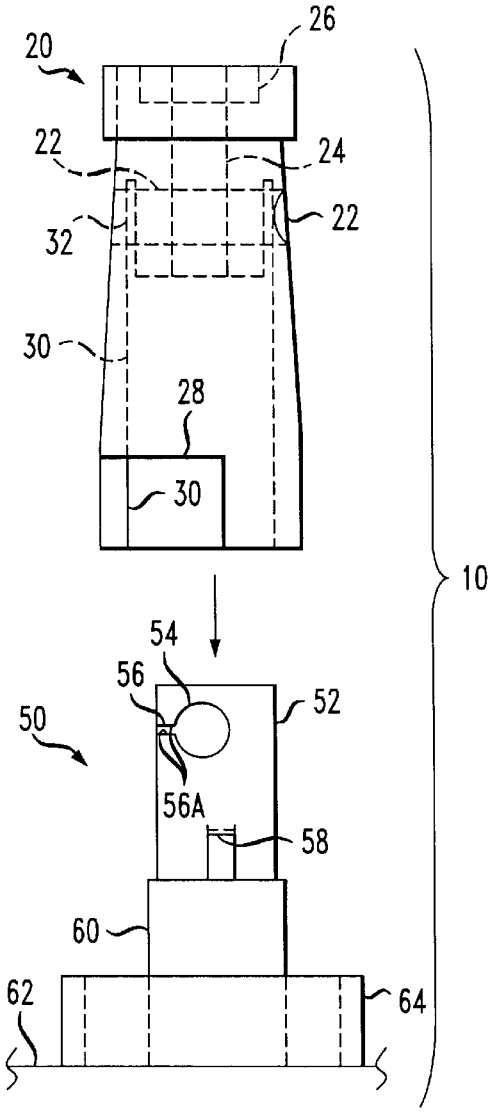
FIG. 1A PRIOR ART
FIG. 1A is an exploded side elevation view of a conventional connector.
Figure 1B:
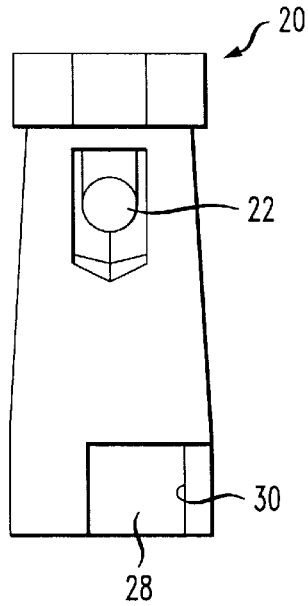
FIG. 1B PRIOR ART
FIG. 1B is a front elevation view of the cap shown in FIG. 1A.
Figure 1D:
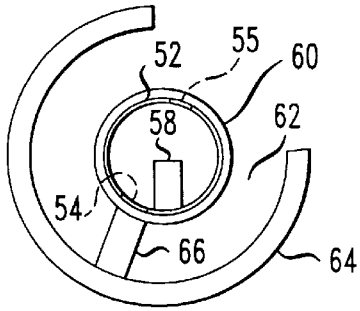
FIG. 1D PRIOR ART
FIG. 1D is a top elevation view of the terminal shown in FIG. 1A.

Reference is again made to FIGS. 2B and 2D. The side wall of the cap 120 has a hole 104 for a test probe. The hole 104 of the cap 120 is adjacent to a solid wall 52*a* (shown in FIG. 2D) of the terminal 52 when the cap is in at least one of the group consisting of first position and the second position. Preferably, the hole 104 is an entrance to a passage that extends diagonally downward. It is relatively easy to insert a probe (not shown) to touch the terminal surface 52*a*, and is not significantly more difficult than using the top surface test probe 24 of the prior art (FIG. 1C).

The top surface 101 has a receptacle 106 for a rotating tool. The receptacle and rotating tool may be, for example, a slot 106 and a slotted screw driver (not shown), respectively. Preferably, the passage 102 of the cap 120 does not penetrate the receptacle 106.

Other types of rotating tools may be used, such as a Phillips head, or an Allen head, with corresponding Phillips or Allen head receptacles. Alteratively, the perimeter of the top surface of the cap may be hexagonal, in which case a socket may be used to rotate the cap. Other types of receptacles may be used, with the appropriate rotating tool.

FIGS. 4A–4D show a second exemplary embodiment of the invention. The reference numerals of the elements in FIGS. 4A–4D have the same two least significant digits as the corresponding elements in FIGS. 2A–2E. Except for the passage 202, the remaining elements shown in FIGS. 4A–4D are the same as those described above with reference to FIGS. 2A–2E, and, for brevity, descriptions of those elements are not repeated.

Thus, the phrase, "the passage having a first end at a top end of the cap" may refer to a passage 102 (FIG. 2D) that penetrates the top surface 101 of the cap 100, or a passage 202 (FIG. 4D) that penetrates the side surface of the cap, near the top surface 201.

As shown in FIGS. 4A–4D, the wire receiving hole 202*a* does not necessarily have to penetrate the top surface 201. The hole 202*a* may be at the top end of the cap 200, on the side wall, so the wire is still inserted diagonally in passage 202. Preferably, the hole 202*a* begins at the top corner of cap 200, as shown. Nevertheless, hole 202*a* may alternatively be positioned a short distance from the top corner.

The position of hole 202*a* may be chosen so that a wire inserted into passage 202 clears the top of terminal 52. Alternatively, an additional hole (not shown) may be formed in the terminal 52 near its top end, so the wire can pass through the terminal.

Also, the passage 202 should be at a height and angle so that hole 54 is substantially centered in passage 202 when the cap is in the first position (for wire insertion), and slot 56 is substantially centered in passage 202 when the cap is in the second position (for forming an electrical connection). In general, the closer hole 202*a* is to the top surface 201, the easier wire insertion is expected to be.

Although the invention has been described in terms of exemplary embodiments, it is not limited thereto. Rather, the appended claim should be construed broadly, to include other variants and embodiments of the invention which may be made by those skilled in the art without departing from the scope and range of equivalents of the invention.

What is claimed is:

1. A connector comprising:

a base;

a cylindrical terminal attached to the base, the terminal having a hole in a side wall thereof and a horizontal slot extending from the hole;

a cap mounted on the base so as to substantially cover the terminal, the cap having a top surface and a passage surrounded by passage walls, the passage having a first end penetrating the top surface of the cap and a second end penetrating a side wall of the cap, the cap being rotatable between:

a first position in which the passage is aligned with the hole of the terminal so the passage extends continuously from the first end of the passage through the hole to the second end of the passage, and a second position in which the second end of the passage is adjacent the horizontal slot, so the passage extends continuously from the first end of the passage through the slot to the second end of the passage wherein the top surface is a furthest surface of the cap from the base.

2. The connector of claim 1, wherein the side wall of the cap has a hole therethrough separate and distinct from the passage, for receiving a probe, the hole of the cap being adjacent to a solid wall of the terminal when the cap is in at least one of the group consisting of the first position and the second position.

3. The connector of claim 1, wherein:

the top surface has a receptacle for a rotating tool, and the passage of the cap does not penetrate the receptacle.

4. The connector of claim 1, wherein the terminal is an insulation displacement terminal.

5. The connector of claim 1, wherein:

the base has a plurality of terminals arranged in a grid having a plurality of rows and a plurality of columns, and the connector is surrounded by additional connectors.

6. The connector of claim 1, wherein the passage of the cap is diagonal.

7. The connector of claim 1, wherein the top surface is above a top end of the terminal.

8. The connector of claim 1, wherein the cap is free of any structure above the top surface.

9. A cap for a connector having a base and a cylindrical terminal attached to the base, the terminal having a hole in a side wall thereof and a horizontal slot extending from the hole, said cap having a side wall and a top surface that substantially cover the terminal, said cap having a passage therethrough surrounded by passage walls, the passage having a first end penetrating the top surface of said cap and a second end penetrating the side wall of said cap, said cap being mountable on the base and rotatable between:

a first position in which the passage is aligned with the hole of the terminal so the passage extends continuously from the first end of the passage through the hole to the second end of the passage, and a second position in which the second end of the passage is adjacent the horizontal slot, so the passage extends continuously from the first end of the passage through the slot to the second end of the passage wherein the top surface is a furthest surface of the cap from the base.

10. The cap of claim 9, wherein the side wall of the cap has a hole therethrough, the hole of the cap being adjacent to a solid wall of the terminal when the cap is in at least one of the group consisting of first position and the second position.

11. The cap of claim 9, wherein:

the top surface has a receptacle for a rotating tool, and the passage of the cap does not penetrate the receptacle.

12. The cap of claim 9, wherein the passage is diagonal.

13. The cap of claim 9, wherein the top surface is above a top end of the terminal.

14. The cap of claim 9, wherein the cap is free of any structure above the top surface.

15. A method for forming an electrical connection to an insulation displacement connector having a cap, the cap having a top surface and a side surface, the connector having a cylindrical terminal, the terminal having a hole connected to a slot, the hole and the slot surrounded by material, the method comprising the steps of:

inserting a wire through a passage in the cap surrounded by passage walls, the passage penetrating the top surface of the cap and extending continuously through the hole in the terminal, so the wire exits from a side of the cap; and rotating the cap, so that the wire is gripped between cutting edges of the cylindrical terminal, to form an electrical connection wherein the connector has a base to which the terminal is attached, and the top surface is a furthest surface of the cap from the base.

16. The method of claim 15, wherein the inserting step includes inserting the wire diagonally.

17. The method of claim 15, wherein the top surface is above a top end of the terminal.

* * * * *